US006041212A

United States Patent [19]

Okada

[11] Patent Number: 6,041,212

[45] Date of Patent: Mar. 21, 2000

[54] TONER REPLENISHING DEVICE OF IMAGE FORMING MACHINE AND TONER CARTRIDGE FOR USE THEREIN

[75] Inventor: Mitsuharu Okada, Osaka, Japan

[73] Assignee: Mita Industrial Co., Ltd., Osaka, Japan

[21] Appl. No.: 09/178,535

[22] Filed: Oct. 26, 1998

[30] Foreign Application Priority Data

Nov. 6, 1997 [JP] Japan ..... 9-304330

[51] Int. Cl.[7] ..... G03G 21/00

[52] U.S. Cl. ..... 399/359

[58] Field of Search ..... 399/119, 262, 399/358, 359

[56] References Cited

U.S. PATENT DOCUMENTS 5,737,680 4/1998 Takagaki et al. ..... 399/359

5,848,342 12/1998 Tanda ..... 399/358

5,887,224 3/1999 Mizuishi et al. ..... 399/62

*Primary Examiner*—William Royer

*Assistant Examiner*—Greg Moldafsky

*Attorney, Agent, or Firm*—Smith, Gambrell & Russell, LLP

[57] ABSTRACT

A toner cartridge includes a container body having a toner transport passage, and a toner transporter disposed in the toner transport passage for transporting toner from one end portion toward the other end portion of the toner transport passage while agitating the toner along the toner transport passage. The container body has a toner discharge port provided at the other end portion of the toner transport passage, and a recycle toner entry port provided at the one end portion of the toner transport passage. When the toner cartridge is mounted at a predetermined position, the toner discharge port is positioned opposite a toner feed port provided in a developing device, while the recycle toner entry port is positioned opposite a recycle toner drop port provided in a recycle toner carrier.

8 Claims, 10 Drawing Sheets

TONER REPLENISHING DEVICE OF IMAGE FORMING MACHINE AND TONER CARTRIDGE FOR USE THEREIN

FIELD OF THE INVENTION

This invention relates to a toner replenishing device for replenishing a developing device with a toner in an image forming machine, such as an electrostatic copier or an electrostatic printer, and a toner cartridge for use in such a toner replenishing device.

DESCRIPTION OF THE PRIOR ART

This type of image forming machine has a photoconductor drum rotatably disposed in a machine housing, a developing device for applying a toner to an electrostatic latent image formed on the circumferential surface of the photoconductor drum to develop it to a toner image, a cleaning device for removing the remaining toner adhering to the circumferential surface of the photoconductor drum, and a toner replenishing device for supplying fresh toner to the developing device. The toner replenishing device is adapted to work when the toner concentration of a developer accommodated in the developing device falls below a predetermined value as an image forming operation proceeds. After beginning to work, the toner replenishing device supplies toner to the developing device. This type of toner replenishing device generally uses a so-called cartridge system comprising a toner cartridge which accommodates toner and which can be detachably mounted on a hopper of the developing device.

Other types of image forming machines are also in actual use. They are adapted to recover the remaining toner removed from the circumferential surface of the photoconductor drum by the cleaning device, and recycle the recovered toner to the developing device so that the toner can be reused in the developer. The recycler toner to be used again is carried to the hopper, in which it is agitated and mixed with fresh toner supplied from the toner cartridge, and then fed to the developing device.

The above-described image forming machine needs to have a mechanism for agitating and mixing the recycle toner carried to the hopper and fresh toner. Thus, the hopper becomes large in size, and the number of the constituent parts used increases, resulting in increased costs.

SUMMARY OF THE INVENTION

The object of the present invention is to provide a toner replenishing device of an image forming machine which can be freed of a hopper by agitating and mixing recycle toner and fresh toner through the use of an agitating function that a toner cartridge has; and to provide the toner cartridge for use in the toner replenishing device.

To attain the above object, the present invention provides a toner replenishing device of an image forming machine comprising a photoconductor drum rotatably disposed in a machine housing, a developing device for applying toner to an electrostatic latent image formed on a circumferential surface of the photoconductor drum to develop it to a toner image, a cleaning device for removing the remaining toner adhering to the circumferential surface of the photoconductor drum, recycle toner carrier means for carrying the remaining toner removed by the cleaning device, and a toner cartridge accommodating toner to be fed to the developing device, the toner cartridge being adapted to be detachably mounted in the machine housing; wherein the toner cartridge comprises a container body having a toner transport passage, and toner transporter means disposed in the toner transport passage for transporting toner from one end portion toward the other end portion of the toner transport passage while agitating the toner along the toner transport passage, and the container body has a toner discharge port provided at the other end portion of the toner transport passage, and a recycle toner entry port provided at the one end portion of the toner transport passage; and when the toner cartridge is mounted at a predetermined position, the toner discharge port is positioned opposite a toner feed port provided in the developing device, while the recycle toner entry port is positioned opposite a recycle toner drop port provided in the recycle toner carrier means.

In the container body of the toner cartridge, it is desirable that a toner agitation passage is formed parallel to the toner transport passage, and toner agitator means for moving toner toward the toner transport passage while agitating it is disposed in the toner agitation passage. The recycle toner entry port is provided at an upper site of the one end portion of the toner transport passage.

Desirably, the toner cartridge is adapted to be inserted from the front side toward the rear side of the machine housing until it reaches the predetermined position. Also desirably, a shutter member for closing the toner discharge port is slidably disposed in the container body, and the developing device is provided with shutter operator means which, when the toner cartridge is mounted at the predetermined position, causes the shutter member to slide, opening the toner discharge port. Also desirably, a shutter member for closing the recycle toner entry port is slidably disposed in the container body, and the recycle toner carrier means is provided with shutter operator means which, when the toner cartridge is mounted at the predetermined position, causes the shutter member to slide, opening the recycle toner entry port. Further desirably, a shutter member for closing the recycle toner drop port is slidably disposed in the recycle toner carrier means, and the container body is provided with shutter operator means which, when the toner cartridge is mounted at the predetermined position, causes the shutter member to slide, opening the recycle toner drop port.

The present invention also provides a toner cartridge for use in a toner replenishing device of an image forming machine, the toner cartridge accommodating toner to be fed to a developing device for applying toner to an electrostatic latent image formed on the circumferential surface of a photoconductor drum disposed in a machine housing to develop it to a toner image, the toner cartridge comprising a container body having a toner transport passage, and toner transporter means disposed in the toner transport passage for transporting toner from one end portion toward the other end portion of the toner transport passage while agitating the toner along the toner transport passage; wherein the container body has a toner discharge port provided at the other end portion of the toner transport passage, and a recycle toner entry port provided at the one end portion of the toner transport passage, and when the toner cartridge is mounted at a predetermined position, the toner discharge port is opposed to a toner feed port provided in the developing device, while the recycle toner entry port is opposed to a recycle toner drop port provided in recycle toner carrier means for carrying the remaining toner removed from the circumferential surface of the photoconductor drum.

Other features of the present invention will become apparent from the following description.

DETAILED DESCRIPTION OF THE PREFERRED EMBODIMENTS

Preferred embodiments of a toner replenishing device of an image forming machine, and a toner cartridge for use therein, which are constructed in accordance with the present invention will be described in detail by reference to the appended drawings.

Figure 1:
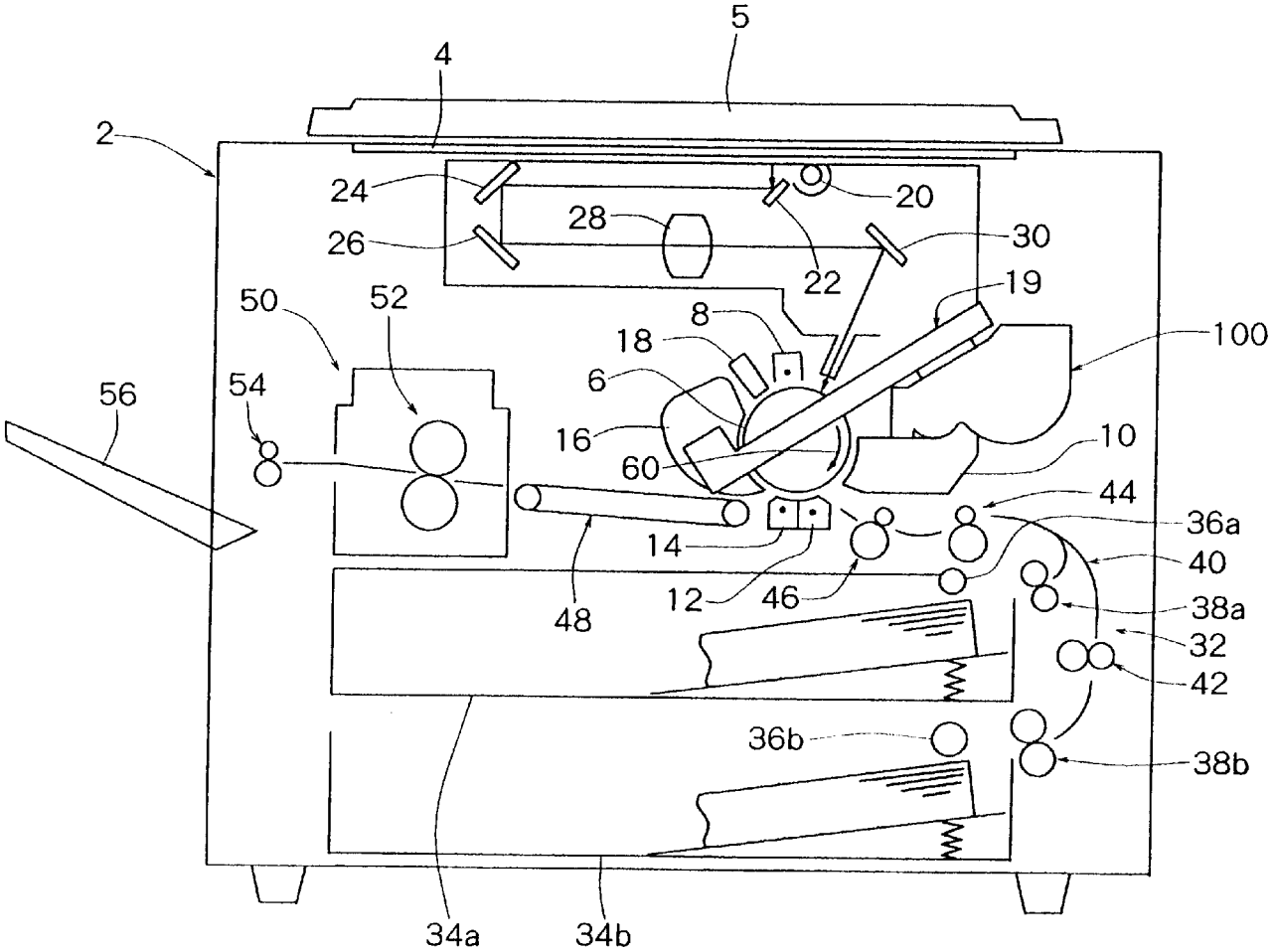
FIG. 1 is a schematic constitutional sectional view showing an embodiment of an image forming machine equipped with a toner replenishing device constructed in accordance with the present invention.
Figure 2:
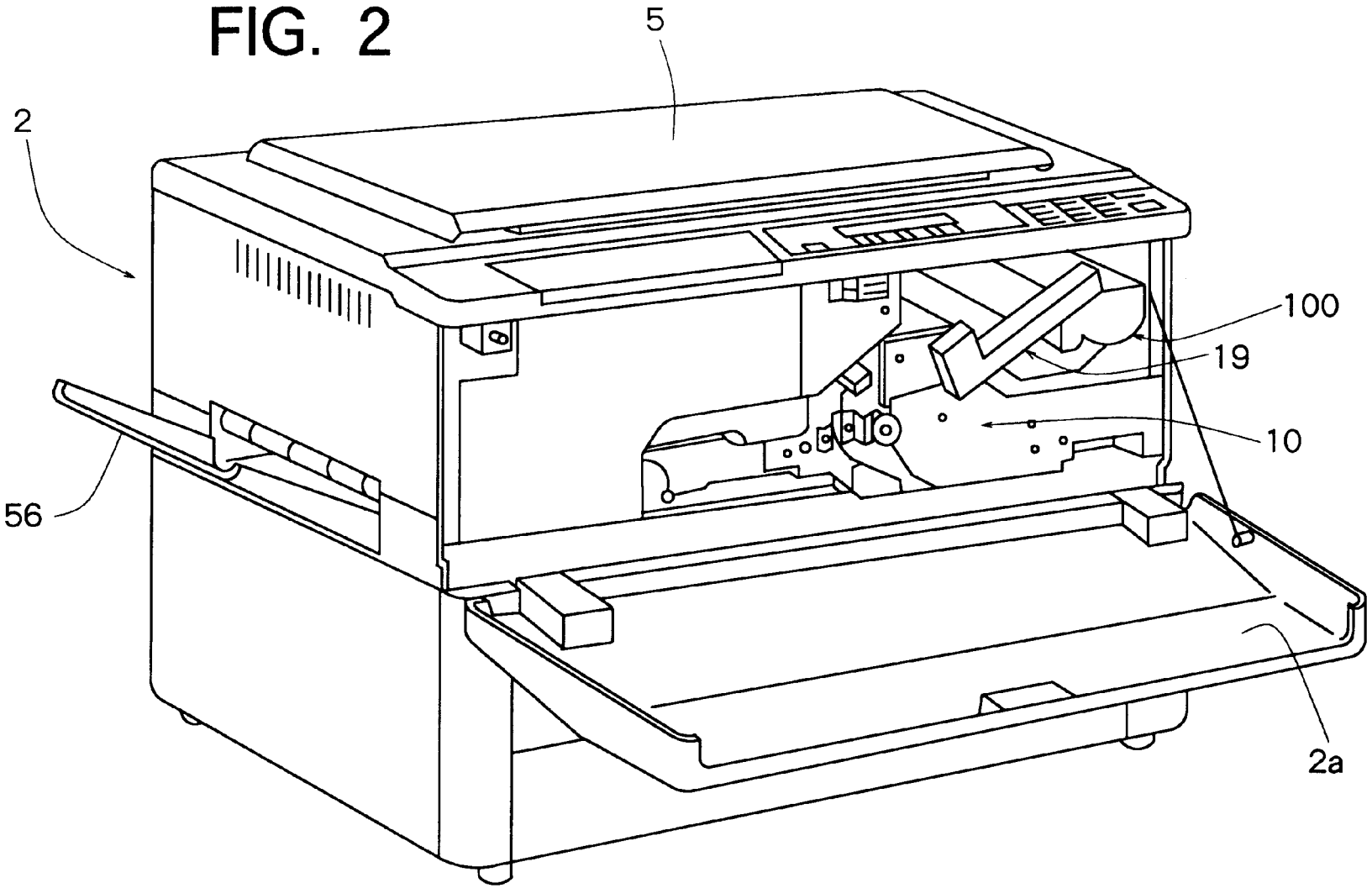
FIG. 2 is a perspective view of the image forming machine of FIG. 1.

FIGS. 1 and 2 show an electrostatic copier, as an image forming machine, equipped with a toner replenishing device constructed in accordance with the present invention. The illustrated electrostatic copier has a rectangular parallelopipedal machine housing 2. On an upper surface of the machine housing 2, a stationary transparent platen 4 is disposed for bearing a document to be copied, and an openable/closable document holding plate 5 is disposed for covering the stationary transparent platen 4 and the document borne thereon. In a nearly central part of the machine housing 2, a photoconductor drum 6 is rotatably disposed as shown in FIG. 1. The photoconductor drum 6 is rotationally driven in a direction indicated by an arrow 60 by driving means (not shown). Around the photoconductor drum 6, a charging corona discharger 8, a developing device 10, a transferring corona discharger 12, a peeling corona discharger 14, a cleaning unit 16, and a static eliminator lamp 18 are disposed in this order when viewed in the direction of rotation indicated by the arrow 60. In the illustrated embodiment, recycle toner carrier means 19 is disposed for carrying the remaining toner, removed from the circumferential surface of the photoconductor drum 6 by the cleaning unit 16, to a toner cartridge to be described later on.

The illustrated electrostatic copier has an optical system disposed above the photoconductor drum 6 and comprising an illumination lamp 20, a first mirror 22, a second mirror 24, a third mirror 26, a lens 28, and a fourth mirror 30. This optical system is adapted to cast light on a document placed on the stationary transparent platen 4 by means of the illumination lamp 20, and focuses its reflected light image on the outer peripheral surface of the photoconductor drum 6 via the first mirror 22, second mirror 24, third mirror 26, lens 28, and fourth mirror 30. The illustrated electrostatic copier has a transfer sheet feeder 32 for feeding a transfer sheet to a transfer area defined between the transferring corona discharger 12 and the photoconductor drum 6. The transfer sheet feeder 32 has transfer sheet cassettes 34*a*, 34*b* for accommodating transfer sheets, transfer sheet delivery rollers 36*a*, 36*b*, separation roller pairs 38*a*, 38*b*, a guide passage 40, transport roller pairs 42 and 44, and a register roller pair 46. The respective roller pairs of the so constructed transfer sheet feeder 32 are each rotationally driven by driving means (not shown). On the transfer sheet let-off side of the transfer area, a transfer sheet transport belt mechanism 48, a fixing roller pair 52 constituting a fixing device 50, and a discharge roller pair 54 are disposed. The transport belt mechanism and the rollers are each rotationally driven by driving means (not shown). On a front surface of the machine housing 2 in which the respective members are disposed, a front cover 2*a* is mounted so as to be openable and closable with its lower edge as a fulcrum as shown in FIG. 2.

In the so constructed electrostatic copier, while the photoconductor drum 6 is being rotationally driven in the direction of the arrow 60, the charging corona discharger 8 charges a photosensitive material on the photoconductor drum 6 to a specific polarity substantially uniformly. Then, the illumination lamp 20 illuminates a document placed on the stationary transparent platen 4. Its reflected light image is scan projected onto the photoconductor drum 6 via the first mirror 22, second mirror 24, third mirror 26, lens 28 and fourth mirror 30 to form an electrostatic latent image on the photoconductor drum 6. Then, the electrostatic latent image on the photoconductor drum 6 is developed to a toner image by the developing device 10. A transfer sheet accommodated in the transfer sheet cassette 34*a* or 34*b* of the transfer sheet feeder 32 is delivered to the guide passage 40 by the transfer sheet delivery roller 36*a* or 36*b*, temporarily stopped at the register roller pair 46, and transported to the transfer area in synchronism with the toner image formed on the photoconductor drum 6. The transfer sheet transported to the transfer area receives the toner image while passing between the photoconductor drum 6 having the toner image formed thereon and the transferring corona discharger 12. The toner image-transferred transfer sheet is peeled from the photoconductor drum 6 by the action of the peeling corona discharger 14, transported to the fixing device 50 by the transfer sheet transport belt mechanism 48 for fixing under heat, and discharged onto a copy receiving tray 56 through the discharge roller pair 54. The photoconductor drum 6 which has finished the transfer step in the above manner is cleared by the cleaning unit 16 of the toner that has adhered to its outer peripheral surface. Further, the surface of its photosensitive material is illuminated with static eliminating light by the static eliminator lamp 18, whereby its static electricity is removed. The remaining toner that has been removed from the circumferential surface of the photoconductor drum 6 by the cleaning unit 16 is carried to a toner cartridge of a toner replenishing device (to be described later on) by the recycle toner carrier means 19.

The illustrated electrostatic copier has a toner cartridge 100 constituting a toner replenishing device for replenishing the aforementioned developing device 10 with toner. The toner cartridge 100 will be described with reference to FIGS. 3 to 5.

The toner cartridge 100 has a container body 101. The container body 101 is composed of a box-shaped lower housing 110 with an open upper surface, and a box-shaped upper housing 120 with an open lower surface. The lower housing 110 and the upper housing 120 are both formed of suitable synthetic resin, and the upper surface of the lower housing 110 is bonded to the lower surface of the upper housing 120 by a suitable bonding means such as an adhesive. In the so constructed container body 101 of the toner cartridge 100, toner 102 for replenishment is accommodated.

Figure 3:
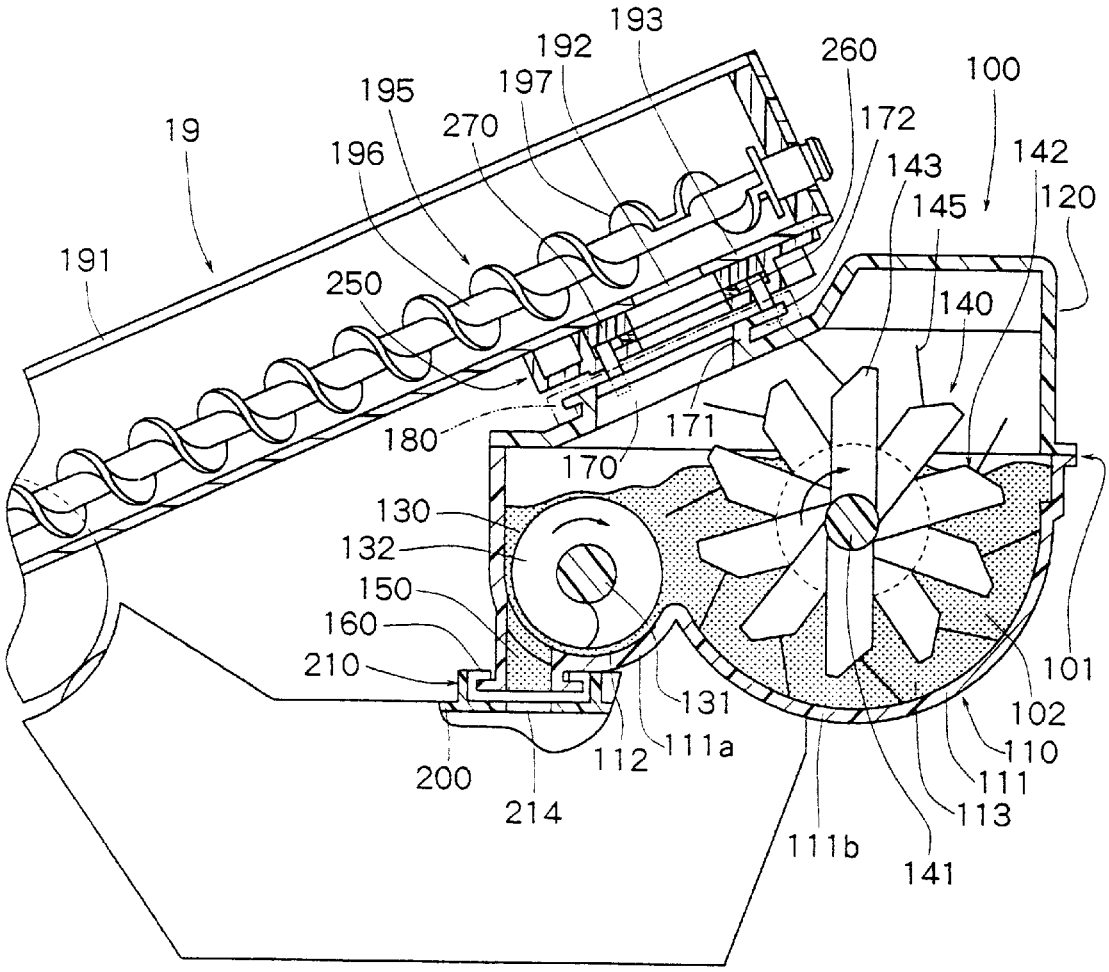
FIG. 3 is a sectional view of the toner replenishing device constructed in accordance with the present invention.

A bottom wall 111 of the lower housing 110 constituting the container body 101 of the toner cartridge 100 is constituted by a first arcuate portion 111*a* with a relatively small radius of curvature, and a second arcuate portion 111*b* with a relatively large radius of curvature when viewed in cross section in FIG. 3. Thus, in the lower housing 110, a toner transport passage 112 defined by the first arcuate portion 111*a*, and a toner agitation passage 113 defined by the second arcuate portion 111*b* are formed parallel in the longitudinal direction.

Figure 5:
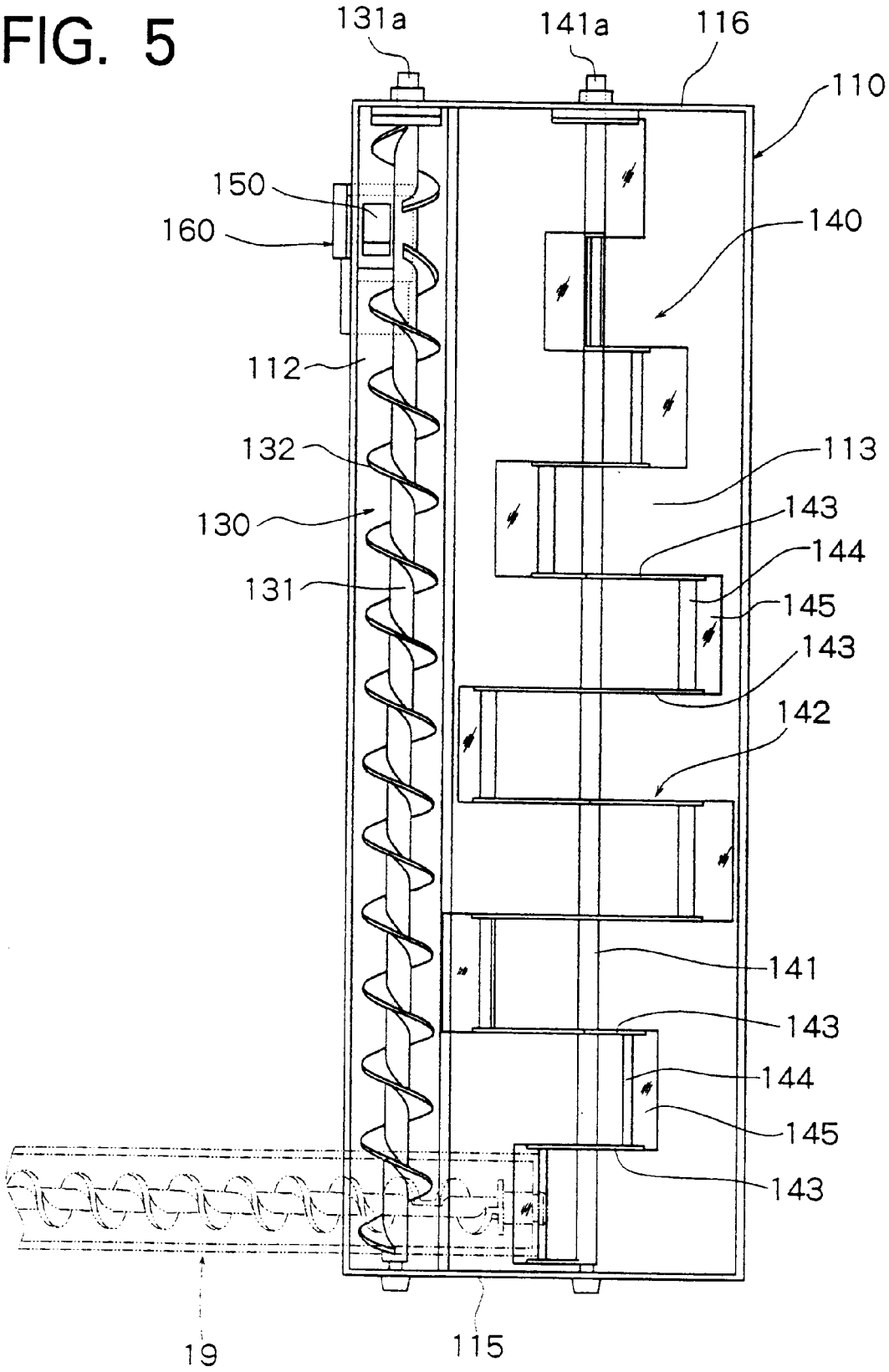
FIG. 5 is a plan view showing a state in which an upper housing of the toner cartridge of FIG. 4 constructed in accordance with the present invention has been removed.

In the toner transport passage 112, a toner transporter means 130 is disposed. As shown in FIG. 5, the toner transporter means 130 is constituted by a rotating shaft 131, and a helical blade 132 mounted on the rotating shaft 131. The rotating shaft 131 is rotatably supported by a front end wall 115 and a rear end wall 116 of the lower housing 110 constituting the container body 101. At a rear end of the rotating shaft 131, a connector portion 131*a* noncircular in section is formed. This connector portion 131*a* is disposed so as to project outward from the rear end wall 116. The connector portion 131*a* of the rotating shaft 131 is adapted to be drivingly connected to a drive mechanism (not shown) when the toner cartridge 100 is mounted at a predetermined position of the machine housing 2. The so constituted toner transporter means 130 is rotated in a direction indicated by an arrow in FIG. 3 to transport toner in the toner transport passage 112 from one end portion (the front side) toward the other end portion (the rear side) of the toner transport passage 112 (from the bottom side to the top side in FIG. 5) while agitating the toner.

In the toner agitation passage 113, a toner agitator means 140 is disposed. The toner agitator means 140 is constituted by a rotating shaft 141, and an agitator member 142 mounted on the rotating shaft 141. The rotating shaft 141 is rotatably supported by the front end wall 115 and the rear end wall 116 of the lower housing 110 constituting the container body 101 of the toner cartridge 100. The agitator member 142 has a plurality of arms 143 disposed with equal spacing in the axial direction of the rotating shaft 141 so as to protrude radially, and paddles 144 each provided so as to connect the front ends of each pair of the adjacent arms 143. The respective pairs of the arms 143 connected together by the paddles 144 are disposed, as a whole, in a dispersed manner at predetermined angular positions with spacing in the circumferential direction of the rotating shaft 141. The length from the central axis of the rotating shaft 141 to the front end of each arm 143 is the same for all the arms, and the respective paddles 144 are constructed parallel to the rotating shaft. The so constituted rotating shaft 141 and agitator member 142 are integrally molded from suitable synthetic resin. The toner agitator mears 140 in the illustrated embodiment has elastic agitating sheet members 145 mounted on the respective paddles 144. The agitating sheet member 145 is formed of an elastic sheet material of, say, polyethylene terephthalate (PETP) resin, and has its base end bonded to the paddle 144 by a bonding means such as an adhesive. At a rear end of the rotating shaft 141 in the so constituted toner agitator means 140, a connector portion 141*a* noncircular in section is formed. This connector portion 141*a* is disposed so as to project outward from the rear end wall 116. The connector portion 141*a* of the rotating shaft 141 is adapted to be drivingly connected to a drive mechanism (not shown) when the toner cartridge 100 is mounted at a predetermined position of the machine housing 2. The so constituted toner agitator means 140 is rotated in a direction indicated by an arrow in FIG. 3 to move toner in the toner agitation passage 113 toward the toner transport passage 112 while agitating the toner.

In the bottom wall 111 of the lower housing 110 constituting the container body 101 of the toner cartridge 100, a mouth-and-neck portion 151 is provided which has a toner discharge port 150 formed at a position corresponding to the other end portion of the toner transport passage 112. At a lower end of the mouth-and-neck portion 151, a rectangular flange 152 is formed which juts out horizontally from the periphery of the mouth-and-neck portion 151. On this flange 152, a first shutter member 160 is mounted slidably.

Figure 6:
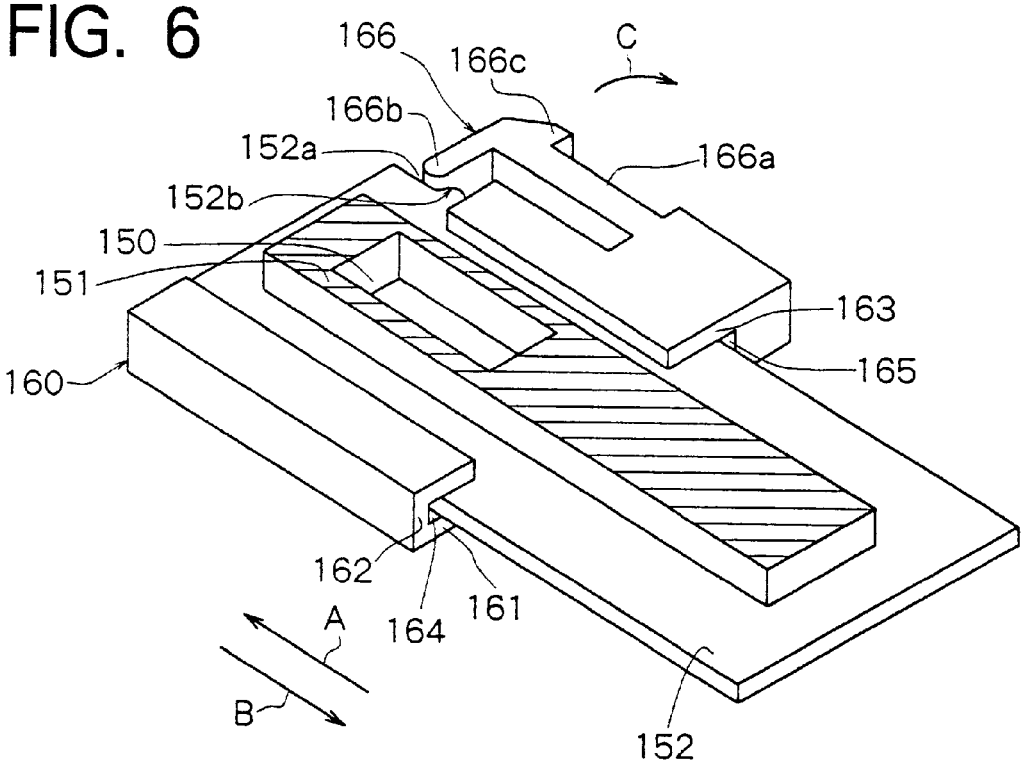
FIG. 6 is a perspective view showing, in an enlarged manner, a first shutter member mounted on a lower housing of the toner cartridge illustrated in FIG. 4.

The first shutter member 160 will be described with reference to FIG. 6. FIG. 6 shows a state in which the toner discharge port 150 is closed with the first shutter member 160. The first shutter member 160 includes a flat plate portion 161 opposed to a lower surface of the flange 152, a left guide 162 extending with an inverted L-shaped section from the left end side of the flat plate portion 161 as viewed in the direction of insertion of the toner cartridge 100 (the direction of an arrow A), and a right guide 163 extending with an inverted L-shaped section from the right end side of the flat plate portion 161 as viewed in the direction of the arrow A. Guide channels 164 and 165 are formed by end portions of the flat plate portion 161 and the left guide 162 and the right guide 163. These guide channels 164 and 165 are fitted over both sides of the flange 152, whereby the first shutter member 160 is slidably mounted on the flange 152. The right guide 163 is provided with an engage-stopping claw 166. The engage-stopping claw 166 comprises an elastically deformable support 166*a* extending in the direction of the arrow A from the right guide 163, a guided portion 166*b* extending inwardly from the front end of the support 166*a*, and an engaging stop 166*c* directed outward from the front end of the support 166*a*. The first shutter member 160 constituted by these parts is integrally molded from suitable synthetic resin.

A left-hand front end, viewed in the direction of the arrow A, of the flange 152 is provided with a notch 152*a*. In a state in which the first shutter member 160 rests at a closing position shown in FIG. 6, the front end of the guided portion 166*b* of the engage-stopping claw 166 enters the notch 152*a*, and the support 166*a* of the engage-stopping claw 166 does not deform. When, from this state, the first shutter member 160 slides relative to the flange 152 in the direction of an arrow B, the front end of the guided portion 166*b* is guided by a guide surface 152*b* forming the notch 152*a*. Thus, the guided portion 166*b* releases from the notch 152*a*, and contacts a left side surface of the flange 152. At this time, the support 166*a* of the engage-stopping claw 166 is warped in the direction of an arrow C, whereupon the engaging stop 166*c* of the engage-stopping claw 166 juts outward.

Figure 4:
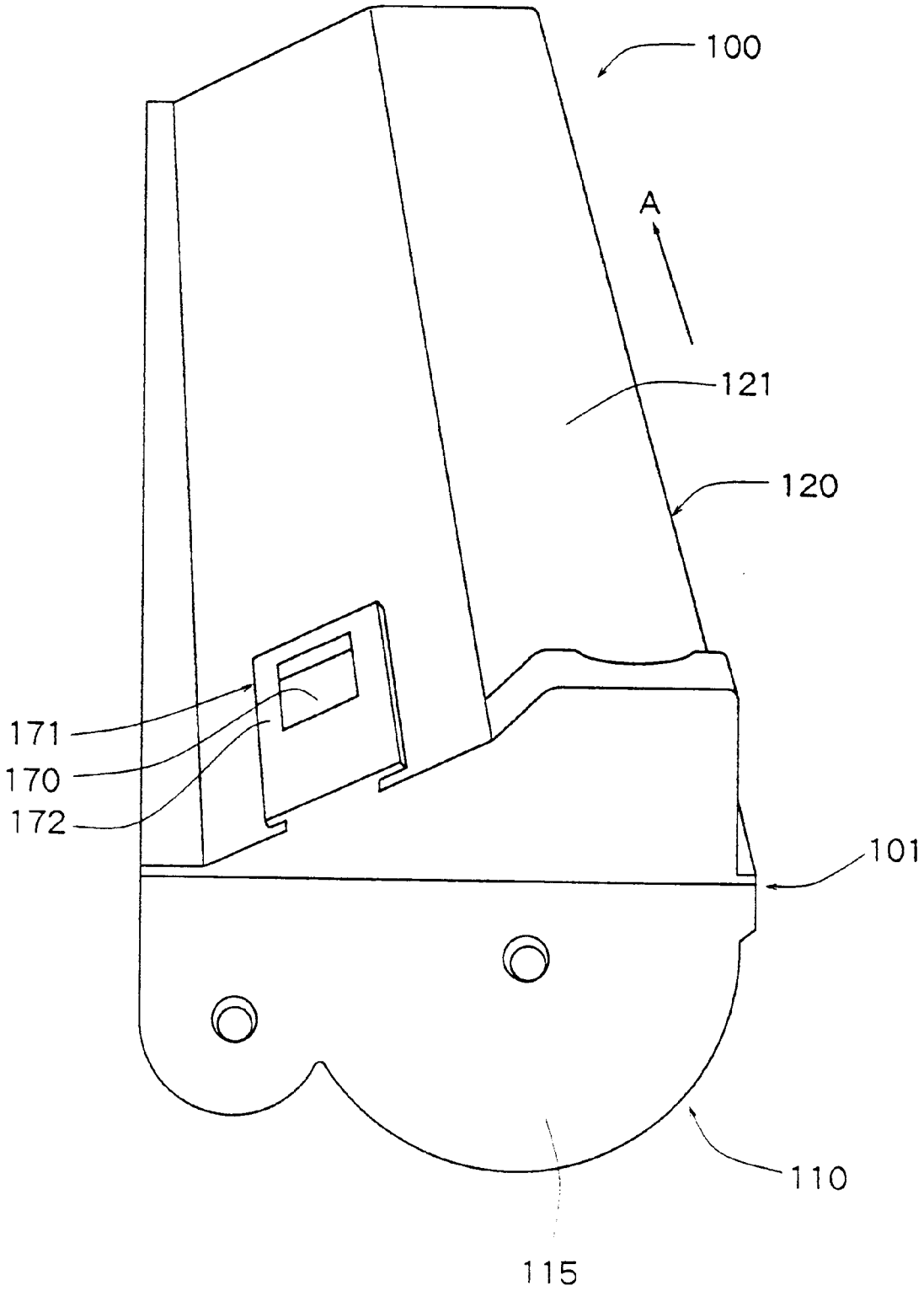
FIG. 4 is a perspective view of a toner cartridge constructed in accordance with the present invention.

Next, the upper housing 120 constituting the container body 101 of the toner cartridge 100 will be described with reference to FIGS. 3 and 4.

Figure 7:
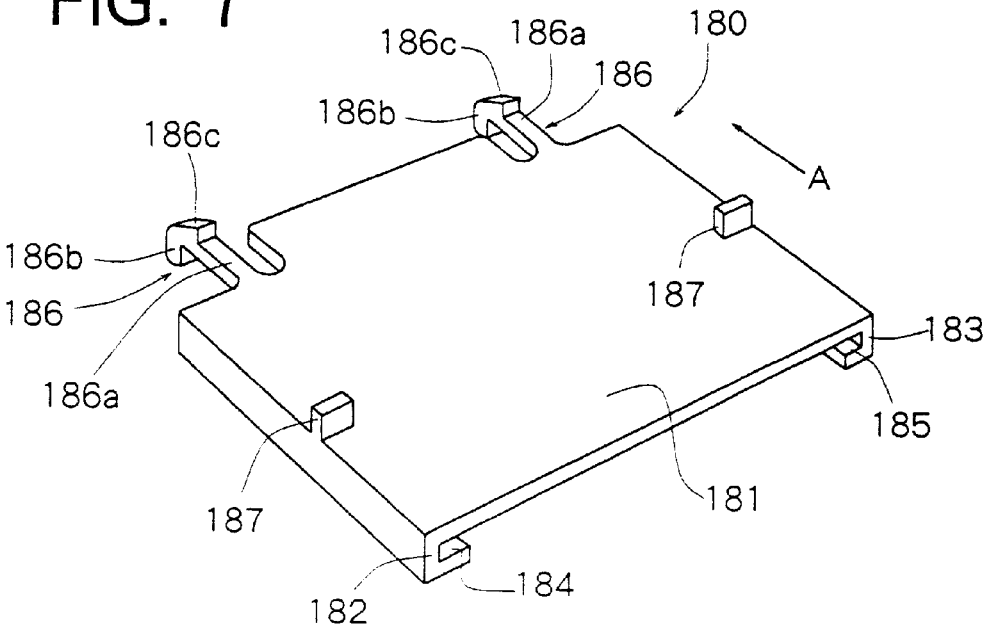
FIG. 7 is a perspective view showing, in an enlarged manner, a second shutter member to be mounted on the upper housing of the toner cartridge illustrated in FIG. 4.
Figure 8:
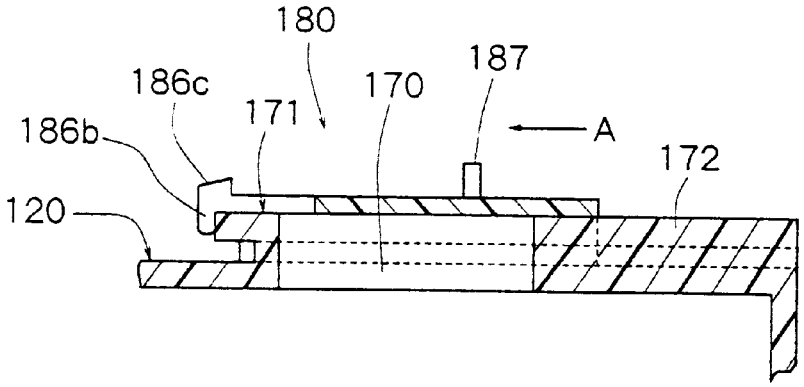
FIG. 8 is a sectional view showing a state in which the second shutter member illustrated in FIG. 7 has been mounted on the upper housing of the toner cartridge.

An upper wall 121 of the upper housing 120 is configured such that its side opposed to the toner transport passage 112 of the lower housing 110 is inclined. In one end portion (a front end portion) of the inclined part of the upper wall 121, a mouth-and-neck portion 171 is provided which has a recycle toner entry port 170 formed at a position corresponding to the toner transport passage 112. At a lower end of the mouth-and-neck portion 171, a rectangular flange 172 is formed which juts out horizontally from the periphery of the mouth-and-neck portion 171. On this flange 172, a second shutter member 180 as shown in FIGS. 7 and 8 is mounted slidably.

The second shutter member 180 will be described with reference to FIGS. 7 and 8. FIG. 7 is a perspective view of the second shutter member 180. FIG. 8 is a sectional view of the essential part of the upper housing 120 which shows a state in which the recycle toner entry port 170 has been closed with the second shutter member 180. The second shutter member 180 includes a flat plate portion 181 opposed to an upper surface of the flange 172, a left grip 182 extending with an inverted L-shaped section from the left end side of the flat plate portion 181 as viewed in the direction of insertion of the toner cartridge 100 (the direction of an arrow A), and a right grip 183 extending with an inverted L-shaped section from the right end side of the flat plate portion 181 as viewed in the direction of the arrow A. Guide channels 184 and 185 are formed by end portions of the flat plate portion 181 and the left grip 182 and the right grip 183. These guide channels 184 and 185 are fitted over both sides of the flange 172, whereby the second shutter member 180 is slidably mounted on the flange 172. At right-hand and left-hand sites of the front end of the flat plate portion 181, engage-stopping claws 186, 186 are provided. The engage-stopping claw 186 comprises an elastically deformable support 186*a* extending in the direction of the arrow A from the flat plate portion 181, a guided portion 186*b* extending inwardly (downwardly) from the front end of the support 186*a*, and an engaging stop 186*c* directed outward (upward) from the front end of the support 186*a*. On both sides of a rear end site of the flat plate portion 181, stoppers 187, 187 are provided which protrude upward. The second shutter member 180 constituted by these parts is integrally molded from suitable synthetic resin.

The toner cartridge 100 in the illustrated embodiment is constituted in the above-described manner. This toner cartridge 100 is inserted from the front side of the machine housing 2, and mounted detachably at a predetermined position. Once the toner cartridge 100 is mounted at the predetermined position, the toner discharge port 150 is located opposite a toner feed port 214 provided in a development housing (to be described later on) of the developing device 10. At the same time, the recycle toner entry port 170 is positioned opposite a recycle toner drop port (to be described later on) provided in the recycle toner carrier means 19.

Figure 9:
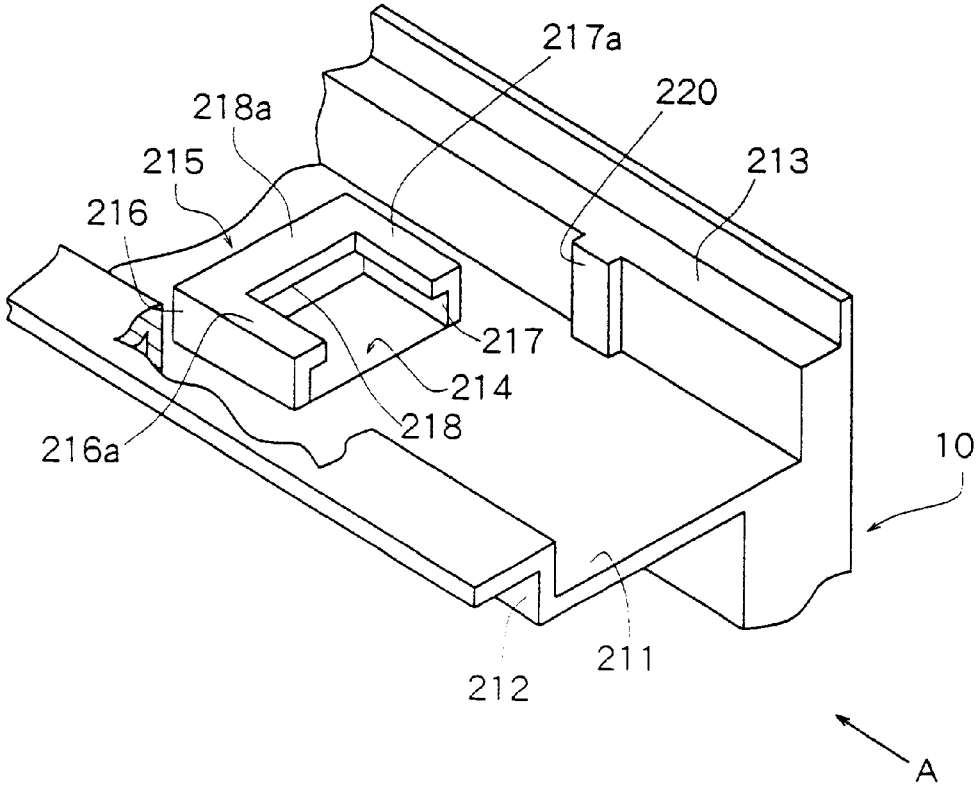
FIG. 9 is a perspective view showing, in an enlarged manner, connector means provided in a developing device mounted on the image forming machine of FIG. 1.

The development housing (to be described later on) of the developing device 10 is provided with a connector means 210 having the toner feed port 214 which connects with the mouth-and-neck portion 151 having the toner discharge port 150 provided in the lower housing 110 that constitutes the container body 101 of the toner cartridge 100 as shown in FIG. 3. The connector means 210 with the toner feed port 214 will be described by reference to FIG. 9.

The connector means 210 is provided at a rear end portion of an upper wall 201 constituting a development housing 200 of the developing device 10. The connector means 210 has a bottom surface portion 211 concurrently used as the upper wall 201 of the development housing 200, and a pair of side wall portions 212, 213 formed parallel along the direction of insertion (indicated by an arrow A) of the toner cartridge 100 so as to protrude upward from both end sides of the bottom surface portion 211. At a predetermined position of the bottom surface portion 211, the toner feed port 214 is formed for feeding toner into the development housing 200. This toner feed port 214 is formed in a rectangular shape in the illustrated embodiment. Around the toner feed port 214, an engagement portion 215 is provided which, at the time of mounting of the torer cartridge 100, is engaged with the rectangular flange 152 formed at the lower end of the mouth-and-neck portion 151 provided in the bottom wall 111 of the lower housing 110. The engagement portion 215 is composed of engaging side wall portions 216, 217 formed so as to protrude upward from the right and left side edges of the toner feed port 214 formed in the bottom surface portion 211 along the direction of insertion of the toner cartridge 100 indicated by the arrow A, a restraining portion 218 formed so as to protrude upward from the rear side edge of the toner feed port 214, and bearing portions 216*a*, 217*b*, 218*a* formed so as to extend inwardly horizontally from the upper ends of the engaging side wall portions 216, 217 and the upper end of the restraining portion 218. The connector means 210 also has an engaging projection 220 disposed on a side wall portion 213 situated rightward when viewed in the direction of insertion of the toner cartridge 100 indicated by the arrow A. The engaging projection 220 is formed so as to protrude inwardly, at a predetermined position of the right-hand side wall portion 213 upstream of the engagement portion 215.

Figure 10:
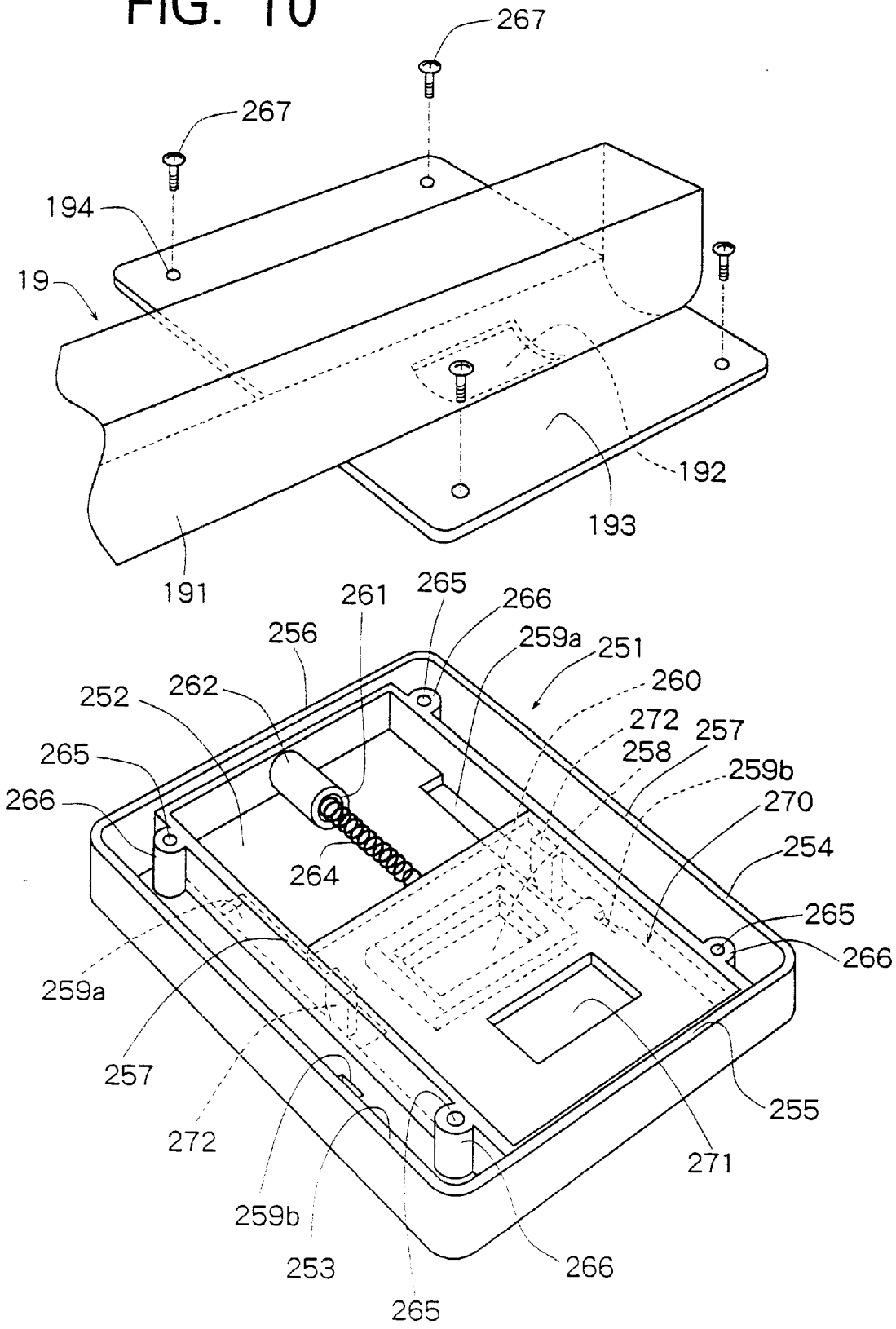
FIG. 10 is a perspective view showing, in an exploded manner, connector means provided in recycle toner carrier means mounted on the image forming machine of FIG. 1.

On the recycle toner carrier means 19, a connector means 250 is mounted for connecting with the mouth-and-neck portion 171 having the recycle toner entry port 170 provided in the upper housing 120 that constitutes the container body 101 of the toner cartridge 100. The recycle toner carrier means 19 and the connector means 250 will be described with reference to FIGS. 3 and 10.

The recycle toner carrier means 19 has a toner carriage pipe 191 connected at one end to a remaining toner carriage portion of the cleaning unit 16, and a toner carriage member 195 disposed in the toner carriage pipe 191. The toner carriage pipe 191 is formed of suitable synthetic resin, and at the other end portion of the toner carriage pipe 191 there is integrally formed a closure member 193 having a recycle toner drop port 192 constituting the connector means 250. At the four corners of this closure member 193, machine screw holes 194 are provided. The toner carriage member 195 is composed of a rotating shaft 196, and a helical blade 197 provided on the rotating shaft 196. The rotating shaft 196 and the helical blade 197 are integrally molded from suitable synthetic resin. One end portion of the rotating shaft 196 constituting the toner carriage member 195 is disposed so as to protrude from one end of the toner carriage pipe 191. This protruding part is drivingly connected to a drive mechanism (not shown).

Next, the connector means 250 includes a shutter holding member 251 mounted on the underside of the closure member 193. The shutter holding member 251 has a bottom wall 252, right and left side walls 253, 254 formed so as to protrude upward from both edge sides of the bottom wall 252, front and rear end walls 255 and 256 formed so as to protrude upward from the front and rear edge sides of the bottom wall 252, and a pair of guide walls 257, 257 formed parallel and inwardly of the right and left side walls 253, 254 on the bottom wall 252 so as to protrude upward. These parts are integrally molded from suitable synthetic resin. In the bottom wall 252, an opening 258 is provided which is opposed to the recycle toner drop port 192 formed in the closure member 193. In the bottom wall 252, a pair of guide walls 259*a*, 259*a* are also provided along the pair of guide walls 257, 257. A pair of engagement holes 259*b*, 259*b* are also formed which are engaged with the engaging stops 186*c*, 186*c* provided on the engage-stopping claws 186, 186 of the second shutter member 180. Around the opening 258 on the upper surface of the bottom wall 252, a seal member 260 formed of a sponge material is mounted by use of an adhesive. A region defined by the inner surfaces of the right and left side walls 253, 254 and the front and rear end walls 255 and 256 is formed in a shape corresponding to the planar shape of the closure member 193, and is adapted to be fitted to the closure member 193. Thus, with the closure member 193 and the shutter holding member 251 being fitted to each other, the recycle toner drop port 192 formed in the closure member 193 and the opening 258 provided in the bottom wall 252 are opposed to each other. The pair of guide walls 257, 257 have a height dimension which is smaller by the thickness of the closure member 193 than the height of the right and left side walls 253, 254 and the front and rear end walls 255 and 256. At a central part of the inner surface of the rear end wall 256, a spring holding portion 262 having a spring insertion hole 261 is formed so as to protrude. A coil spring 264 is inserted into the spring insertion hole 261. At the four corners of the bottom wall 252 constituting the shutter holding member 251, bosses 266 having screw holes 265 are provided at positions corresponding to the machine screw holes 194 provided in the closure member 193. The so constituted shutter holding member 251 is mounted on the toner carriage pipe 191 of the recycle toner carrier means 19 by fitting the region defined by the right and left side walls 253, 254 and the front and rear end walls 255 and 256 to the closure member 193, passing machine screws 267 through the machine screw holes 194 provided in the closure member 193, and screwing the machine screws 267 into the screw holes 265 formed in the bosses 266.

In the so constituted shutter holding member 251, a third shutter member 270 is disposed. The third shutter member 270 has an opening 271, and is disposed so as to be slidable between the pair of guide walls 257, 257 along these guide walls 257, 257. The third shutter member 270 is molded from suitable synthetic resin, and has a pair of engaging legs 272, 272 on both sides of a rear site of its lower surface. The so constituted third shutter member 270 has the pair of engaging legs 272, 272 disposed so as to pass through the pair of guide holes 259*a*, 259*a* provided in the bottom wall 252 of the shutter holding member 251. The third shutter member 270 is pressed so as to move frontward, by the coil spring 264 that acts on the rear end thereof. That is, in the state of FIG. 10 in which the toner cartridge 100 has not been mounted, the third shutter member 270 is moved frontward by the coil spring 264, so that the pair of engaging legs 272, 272 contact the front edge side of the pair of guide holes 259*a*, 259*a*. At this time, the opening 271 provided in the third shutter member 270 is positioned frontward of the recycle toner drop port 192 formed in the closure member 193 and the opening 258 provided in the bottom wall 252. Thus, the third shutter member 270 closes the recycle toner drop port 192.

Figure 11:
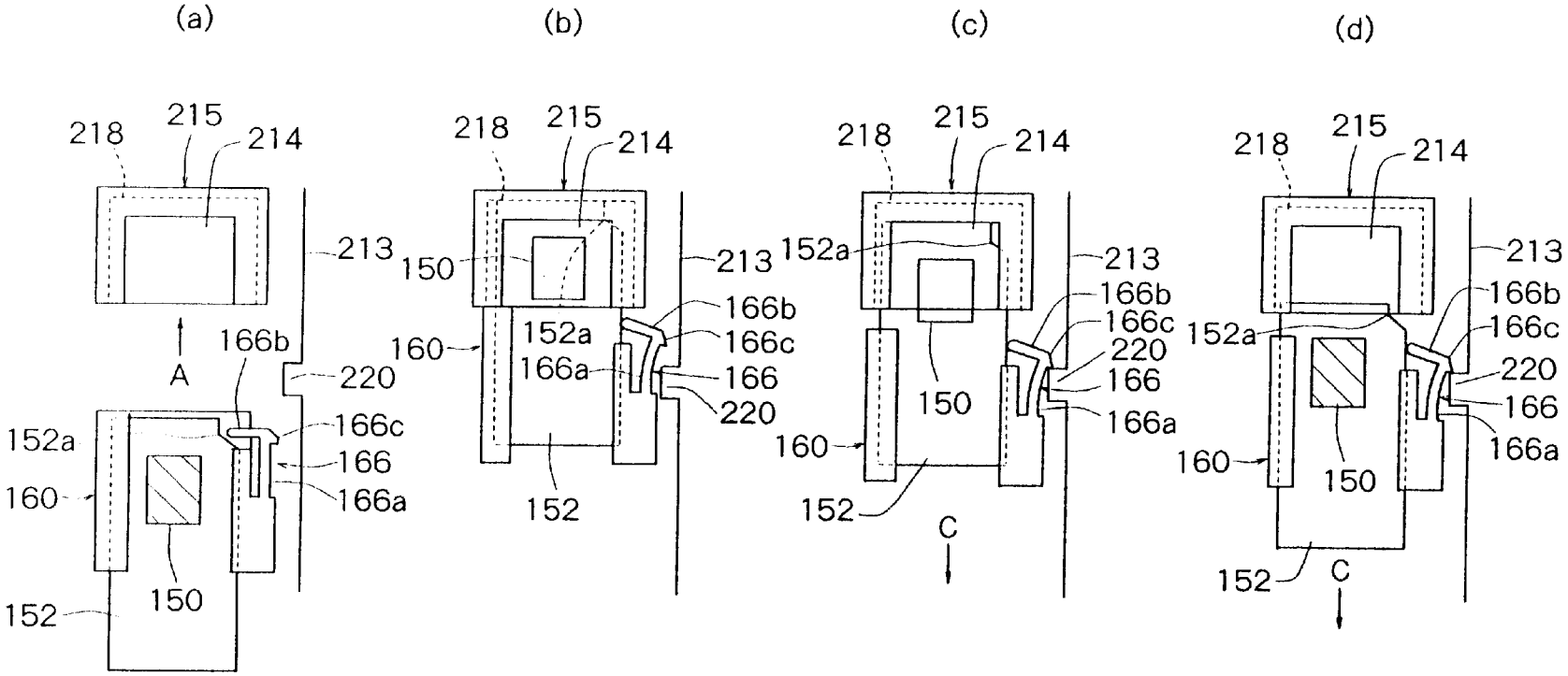
FIG. 11 is an explanatory drawing showing the relation between the first shutter member and the connector means when the toner cartridge of FIG. 4 is mounted on and removed from a machine housing.

The toner replenishing device in the illustrated embodiment is constituted in the above-described manner, and the toner cartridge 100 is mounted after insertion from the front side toward the rear side of the machine housing 2. The relation between the flange 152 provided in the mouth-and-neck portion 151 having the toner discharge port 150 and the first shutter member 160 during the mounting of the toner cartridge 100 will be described with reference to FIG. 11 as well. In FIG. 11, a state in which the toner discharge port 150 is closed with the shutter member 160 is represented by a hatching.

To mount a fresh toner cartridge 100, the toner cartridge 100 is inserted from the front side toward the rear side of the machine housing 2 while being guided by guide means (not shown). At this time, the flange 152 provided in the mouth-and-neck portion 151 having the toner discharge port 150 provided in the toner cartridge 100 moves in the direction of an arrow A while being guided by the bottom surface portion 211 and the pair of side wall portions 212, 213 of the connector means 210. FIG. 11(*a*) shows a state in which the first shutter member 160 closes the toner discharge port 150. Since the front end of the guided portion 166*b* of the engage-stopping claw 166 enters the notch 152*a* formed in the flange 152, the engaging stop 166*c* of the engage-stopping claw 166 does not jut out. Hence, when the toner cartridge 100 is inserted, the engaging stop 166*c* of the engage-stopping claw 166 does not interfere with the engaging projection 220 provided on the right side wall portion 213 of the connector means 210.

When the toner cartridge 100 is inserted rearward from the state of FIG. 11(*a*), the left guide 162 of the first shutter member 160 contacts the left engaging side wall portion 216 of the engagement portion 215, whereby the movement of the first shutter member 160 in the direction of insertion (in the direction of the arrow A) is restrained. When the toner cartridge 100 is inserted further rearward, the flange 152 is inserted into a region partitioned by the engagement portion 215, with the movement of the first shutter member 160 being restrained. The front end of the flange 152 is brought into contact with the restraining portion 218, whereby the movement of the toner cartridge 100 in the direction of insertion is restrained. This means that the first shutter member 160 slides relative to the flange 152 in a direction opposite to the direction of insertion. As a result, the toner discharge port 150 is opened. At this time, the toner discharge port 150 is positioned above and opposite the toner feed port 214 provided in the development housing 200. As noted from this, during the mounting of the toner cartridge 100, the left engaging side wall portion 216 of the engagement portion 215 functions as a shutter operator means which causes the first shutter member 160 to slide relative to the flange 152 in the direction opposite to the direction of insertion, thereby opening the toner discharge port 150.

As the first shutter member 160 slides relative to the flange 152 in the direction opposite to the direction of insertion, the front end of the guided portion 166*b* of the engage-stopping claw 166 is guided along the guide surface 152*b* forming the notch 152*a*, released from the notch 152*a*, and brought into contact with the left side surface of the flange 152. Thus, the support 166*a* of the engage-stopping claw 166 elastically deforms in the direction of an arrow C to warpage, producing a state in which the engaging stop 166*c* of the engage-stopping claw 166 juts out. With the flange 152 being inserted into the region partitioned by the engagement portion 215, followed by its front end being contacted with the restraining portion 218, the mounting of the toner cartridge 100 is completed. In the state in which the toner cartridge 100 is mounted at a predetermined position, the lower housing 110 of the toner cartridge 100 is placed on the bearing portions 216*a*, 217*a*, 218*a* of the engagement portion 215, and the toner discharge port 150 is positioned above and opposite the toner feed port 214 provided in the development housing 200. Thus, toner 102 in the container body 101 of the toner cartridge 100 passes through the opened toner discharge port 150, falls toward the toner feed port 214, and is fed into the development housing 200.

As described above, for the mounting of the toner cartridge 100, the toner cartridge is inserted from the front side toward the rear side of the machine housing 2. As a result, the first shutter member 160 automatically opens the toner discharge port 150. The opened toner discharge port 150 is positioned above and opposite the toner feed port 214 provided in the development housing 200, so that toner is fed from the toner cartridge 100 into the development housing 200. This obviates the step of sliding the shutter member after mounting of the toner cartridge 100 at the predetermined position, to open the toner discharge port 150. The unaware failure to open the shutter member can also be prevented.

Next will follow a description of the relation between the flange 152 and the first shutter member 160, by reference to FIGS. 11(*c*) and 11(*d*), for withdrawing the toner cartridge 100 from the position of mounting in the machine housing 2 to replace the toner cartridge 100 having the toner-consumed container body 101 by a fresh toner cartridge.

The toner cartridge 100 is moved in a direction opposite to the direction of insertion (i.e., in the direction of an arrow C) from the state shown in FIG. 11(*b*) in which the toner cartridge 100 rests at the predetermined position of mounting. As shown in FIG. 11(*c*), the first shutter member 160 has the engaging stop 166*c* of the engage-stopping claw 166 jutting out. Thus, the engaging stop 166*c* engages the engaging projection 220 provided on the right side wall portion 213 of the connector means 210, thereby restraining the movement of the first shutter member 160 in the direction opposite to the direction of insertion (i.e., in the direction of the arrow C). On the other hand, the container body 101 of the toner cartridge 100 moves in the direction opposite to the direction of insertion (i.e., in the direction of the arrow C). This means that the first shutter member 160 slides relative to the flange 152 in the direction of insertion, thus closing the toner discharge port 150 as shown in FIG. 11(*d*). When the toner cartridge 100 moves in the direction opposite to the direction of insertion (i.e., in the direction of the arrow C) from the state shown in FIG. 11(*d*), the front end of the guided portion 166*b* of the engage-stopping claw 166 enters the notch 152*a*. At this time, the support 166*a* of the engage-stopping claw 166 that has been warped because of elastic deformation returns to the original state (FIG. 11(*a*)). Thus, the engaging stop 166*c* of the engage-stopping claw 166 does not interfere with the engaging projection 220 provided on the right side wall portion 213 of the connector means 210. Hence, the toner cartridge 100 can be withdrawn frontward of the machine housing 2, with the first shutter member 160 closing the toner discharge port 150. As noted from this, when the toner cartridge 100 is taken out of the predetermined position of mounting, the first shutter member 160 automatically closes the toner discharge port 150. Thus, the unaware failure to close the toner discharge port 150 can be prevented.

Figure 12:
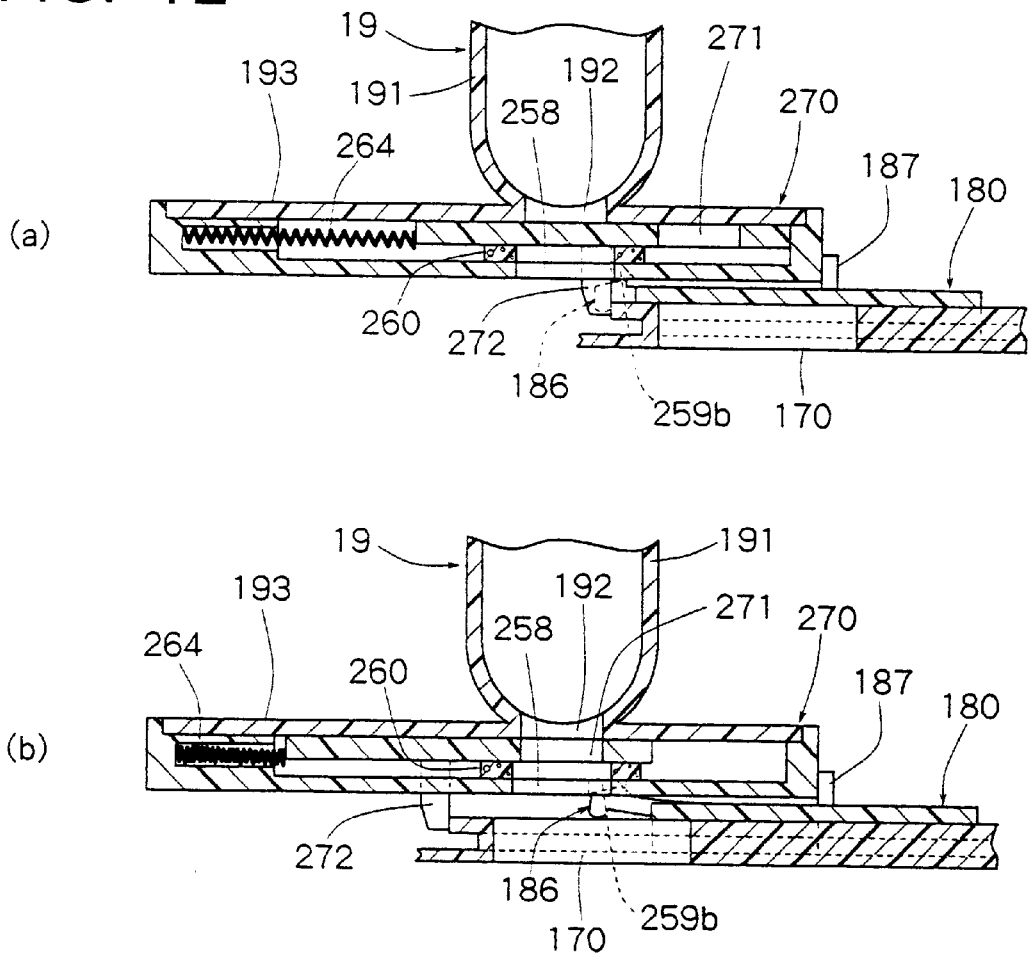
FIG. 12 is an explanatory drawing showing the relation between the second shutter member and the connector means when the toner cartridge of FIG. 4 is mounted on and removed from the machine housing.
Figure 13:
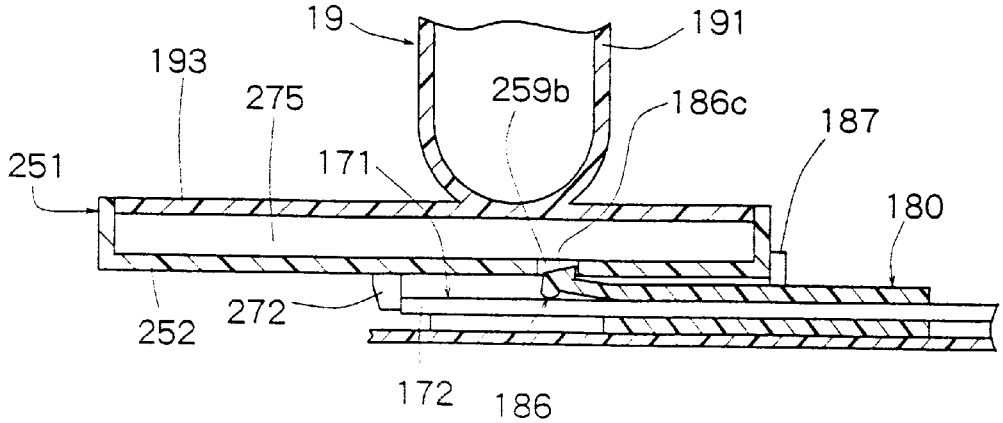
FIG. 13 is a sectional view showing the relation between the second shutter member and the connector means when the toner cartridge of FIG. 4 is mounted on and removed from the machine housing.

Next will follow a description of the relation among the flange 172 formed in the mouth-and-neck portion 171 having the recycle toner entry port 170 provided in the upper housing 120, the second shutter member 180 mounted on the flange 172, and the connector means 250 mounted on the recycle toner carrier means 19, by reference to FIG. 12 as well, when mounting the toner cartridge 100 in the machine housing 2.

When the toner cartridge 100 is inserted from the front side toward the rear side of the machine housing 2 while being guided by guide means (not shown), the second shutter member 180 mounted on the flange 172 moves together with the flange 172, with its flat plate portion 181 closing the recycle toner entry port 170. As shown in FIG. 12(*a*), the stopper 187 provided in the second shutter member 180 contacts the front end portion of the shutter holding member 251, restraining the moving of the second shutter member 180 in the direction of insertion (the direction of arrow A). When the toner cartridge 100 is inserted further rearward, the flange 172 moves in the direction of the arrow A, with the movement of the second shutter member 180 being restrained. Thus, the second shutter member 180 slides relative to the flange 172 in the direction opposite to the direction of insertion, to open the recycle toner entry port 170. As a result, as shown in FIG. 12(*b*), the recycle toner entry port 170 is positioned below and opposite the opening 258 provided in the bottom wall 252 of the shutter holding member 251. As noted from this, at the time of mounting the toner cartridge 100, the front end portion of the shutter holding member 251 that engage-stops the stopper 187 functions as a shutter operator means which causes the second shutter member 180 to slide relative to the flange 172 in the direction opposite to the direction of insertion, thereby opening the recycle toner entry port 170. At this time, the front end of the flange 172 engages the engaging legs 272 provided in the third shutter member 270 to move the third shutter member 270 in the direction of insertion of the toner cartridge 100 (the direction of arrow A) against the spring force of the coil spring 264. Thus, the opening 271 provided in the third shutter member 270 is positioned below and opposite the recycle toner drop port 192 provided in the toner carriage pipe 191 of the recycle toner carrier means 19, to open the recycle toner drop port 192. As noted from this, at the time of mounting the toner cartridge 100, the front end of the flange 172 functions as a shutter operator means which engages the engaging legs 272, causing the third shutter member 270 to slide and open the recycle toner drop port 192. The state shown in FIG. 12(*b*) is the state in which the toner cartridge 100 has been located at the predetermined position of mounting. Once the toner cartridge 100 is positioned at the predetermined position of mounting, the recycle toner drop port 192, the opening 271, the opening 258 and the recycle toner entry port 170 are brought into communication with each other. Thus, the recycle toner carried by the recycle toner carrier means 19 is fed into the container body 101 of the toner cartridge 100 through the recycle toner drop port 192, the opening 271, the opening 258 and the recycle toner entry port 170.

During the process from the state of FIG. 12(*a*) to the state shown in FIG. 12(*b*), the front end of the guided portion 186*b* of the engage-stopping claw 186 is pushed up by the upper surface of the flange 172. Thus, the support 186*a* of the engage-stopping claw 186 is elastically deformed upward to warpage. As a result, the engaging stop 186*c* of the engage-stopping claw 186 is fitted into the engagement hole 259*b* provided in the bottom wall 252 of the shutter holding member 251.

Next, an explanation will be offered for the withdrawal of the toner cartridge 100 from the state in which it has been located at the predetermined position of mounting shown in FIG. 12(*b*).

The toner cartridge 100 is moved in the direction opposite to the direction of insertion (i.e., in the direction of the arrow C) from the state shown in FIG. 12(*b*) in which the toner cartridge 100 rests at the predetermined position of mounting. Even in this case, the second shutter member 180 has the engaging stop 186*c* of the engage-stopping claw 186 fitted into the engagement hole 259*b* provided in the bottom wall 252 of the shutter holding member 251. Thus, the second shutter member 180 is restrained from moving in the direction opposite to the direction of insertion (i.e., in the direction of the arrow C). On the other hand, the container body 101 of the toner cartridge 100 moves in the direction opposite to the direction of insertion (i.e., in the direction of the arrow C). This means that the second shutter member 180 slides relative to the flange 172 in the direction of insertion, thus closing the recycle toner entry port 170 as shown in FIG. 12(*a*). At this time, the front end of the guided portion 186*b* of the engage-stopping claw 186 releases from the upper surface of the flange 172, whereupon the support 186*a* of the engage-stopping claw 186 that has been warped because of elastic deformation returns to the original state (FIG. 12(*a*)). Thus, the engaging stop 186*c* of the engage-stopping claw 186 is detached from the engagement hole 259*b* provided in the bottom wall 252 of the shutter holding member 251. Consequently, the toner cartridge 100 can be withdrawn frontward of the machine housing 2, with the second shutter member 180 closing the recycle toner entry port 170. Furthermore, as the flange 172 moves in the direction opposite to the direction of insertion (i.e., in the direction of arrow C) in accordance with the movement of the toner cartridge 100 in the direction opposite to the direction of insertion (i.e., in the direction of arrow C), the third shutter member 270 is moved frontward by the spring force of the coil spring 264, whereby the recycle toner drop port 192 is closed. As noted from this, when the toner cartridge 100 is taken out of the predetermined position of mounting, the second shutter member 180 automatically closes the recycle toner entry port 170. Thus, the unaware failure to close the recycle toner entry port 170 can be prevented. Moreover, the withdrawal of the toner cartridge 100 results in the automatic closing of the recycle toner drop port 192 by the third shutter member 270. Thus, the unaware failure to close the recycle toner entry port 170 can be prevented.

Next, the agitation and mixing of fresh toner in the toner cartridge 100 and recycle toner which has been carried by the recycle toner carrier means 19 and fed into the toner cartridge 100 will be described by reference to FIGS. 3 and 5.

Recycle toner dropped through the recycle toner drop port 192 of the recycle toner carrier means 19 is fed to one end portion (front end portion) of the toner transport passage 112 formed in the container body 101 of the toner cartridge 100 through the opening 271, opening 258 and recycle toner entry port 170. The recycle toner fed to the toner transport passage 112 is transported toward the other end portion (rear end portion) of the toner transport passage 112 while being agitated by the toner transporter means 130 together with fresh toner that has been accommodated in the toner agitation passage 113 and conveyed to the toner transport passage 112 by the toner agitator means 140. The fresh toner and recycle toner transported to the other end portion of the toner transport passage 112 are passed through the recycle toner discharge port 150, and fed into the development housing 200 through the toner feed port 214. In the illustrated embodiment, recycle toner is carried to the toner cartridge 100 having an agitating/transporting function, in which it is mixed with fresh toner and reused. Thus, there is no need to provide a hopper having an agitating/mixing mechanism for mixing fresh toner from a toner cartridge with recycle toner.

The toner replenishing device of an image forming machine, and the toner cartridge for use therein, in accordance with the present invention are constituted as described above. Thus, they exhibit the following actions and effects:

According to the invention, the toner cartridge comprises the container body having the toner transport passage, and the toner transporter means disposed in the toner transport passage for transporting toner from one end portion toward the other end portion of the toner transport passage while agitating the toner along the toner transport passage, the container body has the toner discharge port provided at the other end portion of the toner transport passage, and the recycle toner entry port provided at the one end portion of the toner transport passage; and when the toner cartridge is mounted at a predetermined position, the toner discharge port is positioned opposite a toner feed port provided in a developing device, while the recycle toner entry port is positioned opposite a recycle toner drop port provided in a recycle toner carrier means. Thus, recycle toner is carried to the toner cartridge having an agitating/transporting function, in which it is mixed with fresh toner and reused. Thus, there is no need to provide a hopper having an agitating/mixing mechanism for mixing fresh toner from the toner cartridge with recycle toner.

What we claim is:

1. A toner replenishing device of an image forming machine comprising a photoconductor drum rotatably disposed in a machine housing, a developing device for applying toner to an electrostatic latent image formed on a circumferential surface of the photoconductor drum to develop it to a toner image, a cleaning device for removing remaining toner adhering to the circumferential surface of the photoconductor drum, recycle toner carrier means for carrying remaining toner removed by the cleaning device, and a toner cartridge accommodating toner to be fed to the developing device, said toner cartridge being adapted to be detachably mounted in the machine housing; wherein the toner cartridge comprises a container body having a toner transport passage, and toner transporter means disposed in the toner transport passage for transporting toner from one end portion toward the other end portion of the toner transport passage while agitating the toner along the toner transport passage, and the container body has a toner discharge port provided at the other end portion of the toner transport passage, and a recycle toner entry port provided at the one end portion of the toner transport passage; and when the toner cartridge is mounted at a predetermined position, the toner discharge port is positioned opposite a toner feed port provided in the developing device, while the recycle toner entry port is positioned opposite a recycle toner drop port provided in the recycle toner carrier means, and wherein a toner agitation passage parallel to the toner transport passage is formed in the container body of the toner cartridge, and toner agitator means for moving toner toward the toner transport passage while agitating it is disposed in the toner agitation passage.

2. The toner replenishing device of an image forming machine as claimed in claim 1, wherein the recycle toner entry port is provided at an upper site of the one end portion of the toner transport passage.

3. The toner replenishing device of an image forming machine as claimed in claim 1, wherein the toner cartridge is adapted to be inserted from the front side toward the rear side of the machine housing until it reaches the predetermined position, a shutter member for closing the toner discharge port is slidably disposed in the container body, and the developing device is provided with shutter member operator means which, when the toner cartridge is mounted at the predetermined position, causes the shutter member to slide, opening the toner discharge port.

4. The toner replenishing device of an image forming machine as claimed in claim 1, wherein the toner cartridge is adapted to be inserted from the front side toward the rear side of the machine housing until it reaches the predetermined position, a shutter member for closing the recycle toner entry port is slidably disposed in the container body, and the recycle toner carrier means is provided with shutter member operator means which, when the toner cartridge is mounted at the predetermined position, causes the shutter member to slide, opening the recycle toner entry port.

5. The toner replenishing device of an image forming machine as claimed in claim 1, wherein the toner cartridge is adapted to be inserted from the front side toward the rear side of the machine housing until it reaches the predetermined position, a shutter member for closing the recycle toner drop port is slidably disposed in the recycle toner carrier means, and the container body is provided with shutter member operator means which, when the toner cartridge is mounted at the predetermined position, causes the shutter member to slide, opening the recycle toner drop port.

6. The toner replenishing device of an image forming machine as claimed in claim 1, wherein the toner cartridge is adapted to be inserted from the front side toward the rear side of the machine housing until it reaches the predetermined position, a first shutter member for closing the toner discharge port is slidably disposed in the container body, a second shutter member for closing the recycle toner entry port is slidably disposed in the container body, a third shutter member for closing the recycle toner drop port is slidably disposed in the recycle toner carrier means, and shutter member operator means are provided which, when the toner cartridge is mounted at the predetermined position, cause the first shutter member, the second shutter member and the third shutter member to slide, opening the toner discharge port, the recycle toner entry port and the recycle toner drop port.

7. A toner cartridge for use in a toner replenishing device of an image forming machine, said toner cartridge accommodating toner to be fed to a developing device for applying toner to an electrostatic latent image formed on a circumferential surface of a photoconductor drum disposed in a machine housing to develop it to a toner image, said toner cartridge being adapted to be detachably mounted in the machine housing, said toner cartridge comprising a container body having a toner transport passage, and toner transporter means disposed in the toner transport passage for transporting toner from one end portion toward the other end portion of the toner transport passage while agitating the toner along the toner transport passage; wherein the container body has a toner discharge port provided at the other end portion of the toner transport passage, and a recycle toner entry port provided at the one end portion of the toner transport passage, and when the toner cartridge is mounted at a predetermined position, the toner discharge port is opposed to a toner feed port provided in the developing device, while the recycle toner entry port is opposed to a recycle toner drop port provided in a recycle toner carrier means for carrying remaining toner removed from the circumferential surface of the photoconductor drum, and wherein a toner agitation passage parallel to the toner transport passage is formed in the container body of the toner cartridge, and toner agitator means for moving toner toward the toner transport passage while agitating it is disposed in the toner agitation passage.

8. The toner cartridge for use in a toner replenishing device of an image forming machine as claimed in claim 7, wherein the recycle toner entry port is provided at an upper site of the one end portion of the toner transport passage.

* * * * *